United States Patent [19]

Cameron

[11] 4,008,452

[45] Feb. 15, 1977

[54] CURRENT LIMITING FUSE DEVICE FOR RELATIVELY HIGH CURRENT

[75] Inventor: Frank L. Cameron, North Huntingdon, Pa.

[73] Assignee: Westinghouse Electric Corporation, Pittsburgh, Pa.

[22] Filed: Aug. 1, 1975

[21] Appl. No.: 601,580

[52] U.S. Cl. ..... 337/284; 337/283; 337/293

[51] Int. Cl.[2] ..... H01H 85/12; H01H 85/04

[58] Field of Search ..... 337/284, 283, 285, 286, 337/288, 293, 274, 233, 199

[56] References Cited

UNITED STATES PATENTS

| | | | |
|---|---|---|---|
| 2,134,470 | 10/1938 | Conrad | 337/284 |
| 3,401,245 | 10/1968 | Cameron | 337/199 |
| 3,740,687 | 6/1973 | Cameron | 337/233 |

*Primary Examiner*—Harold Broome
*Attorney, Agent, or Firm*—M. J. Moran

[57] ABSTRACT

A current limiting fuse and an expulsion fuse are disposed in side by side relationship on a common supporting structure. One terminal of each fuse are interconnected electrically. The other terminals of each fuse are spaced by a predetermined insulating gap. An external circuit which includes a voltage source and a load to be protected is connected in series circuit relationship with the terminals of the expulsion fuse. The current limiting fuse is only disposed in circuit relationship with the external circuit for current limiting purposes when the expulsion fuse blows because of a relatively high value of fault current. This causes gaseous products to be directed from an internal portion of the expulsion fuse to a region between the unconnected terminals of both fuses. This gas conducts electrical current, thus in effect connecting the current limiting fuse in parallel circuit relationship with the expulsion fuse to commutate the fault current from the expulsion fuse to the current limiting fuse to provide a fault current limiting operation.

10 Claims, 4 Drawing Figures

CURRENT LIMITING FUSE DEVICE FOR RELATIVELY HIGH CURRENT

BACKGROUND OF THE INVENTION

The subject matter of this invention is related to fuse devices for conducting high values of rated current while providing a current limiting capability during a fusing operation. The subject matter of this invention relates specifically to the utilization of current limiting fuse devices in combination with expulsion type fuse devices for accomplishing the above result.

It is known that current limiting fuses provide effective current limiting operation when connected in series circuit relationship with a load and source. It is also known that expulsion type fuses when connected in series circuit relationship with a load and source generally do not have significant current limiting capability at high values of rated current but rather provide high voltage isolation after fusing and relatively low impedance to high values of rated load current. On the other hand, current limiting fuses provide relatively high impedance to high values of normal rated load current. A current limiting fuse is disclosed in U.S. Pat. No. 3,740,687, issued June 19, 1973 to F. L. Cameron. An expulsion fuse is disclosed in U.S. Pat. No. 3,401,245, issued Sept. 10, 1968 to F. L. Cameron. Both of the above patents are assigned to the assignee of the present invention. It would be advantageous if an electrical fuse device could be provided for utilization in circuit relationship with a source and load to provide the best features of an expulsion fuse, i.e., high voltage isolation after fusing and relatively low impedance during the conduction of high values of normal rated load current and the best features of a current limiting fuse, i.e., current limitation during a fusing operation for high values of fault current.

SUMMARY OF THE INVENTION

In accordance with the invention an expulsion fuse is utilized with a current limiting fuse. The expulsion fuse and the current limiting fuse are generally disposed side by side on the same mounting or support apparatus. The top terminal of each fuse are interconnected electrically. The bottom terminal of each fuse are not interconnected electrically. Rather, an insulating gap exists between the two bottom terminals. The expulsion type fuse is connected in series circuit relationship with the voltage source and the load to be protected. Disposed on the bottom terminal of the expulsion type fuse is a deflector plate. The expulsion type fuse during a fusing operation will evolve an arc quenching gas. If the magnitude of the fault current is low, the expulsion type fuse performs its normal function and the current limiting fuse does not take part in the fusing operation. However, if the fault fuse current is high the gas generated during the fusing operation will attain a pressure in the confined internal portion of the fuse barrel sufficient to blow out a vinyl cover over a venting hole in the bottom ferrule of the fuse. This allows the pent-up gas to escape. The deflector plate is disposed on or near the bottom terminal or ferrule to direct the gas which escapes towards the unconnected terminal of the current limiting fuse. The hot gas which fills the region between the bottom terminal of the expulsion fuse and the unconnected terminal of the current limiting fuse provides a voltage breakdown path such that electrical current will flow across the gap through the hot gases.

This effectively connects the current limiting fuse in parallel circuit relationship with the expulsion fuse. The expulsion fuse has a mechanical member therein which causes an increasing gap to be provided for isolation purposes during the fusing operation. The arc which is struck in the latter gap after the expulsion fuse element melts and which aids in generating the hot gas is transferred to the gap between the bottom terminal of the current limiting fuse and the bottom terminal of the expulsion fuse after vented gas has been directed to that region. Consequently, the current which causes the fusing action in the expulsion fuse is commutated to the current limiting fuse. After the current limiting fuse element melts due to the presence of the latter current, a high voltage arc is struck between remaining portions thereof which effectively limits the fault current which is flowing therethrough. Restriking of the arc in the expulsion fuse is effectively prevented because the enlarging mechanically drawn gap therein has by this time become so large as to deter even high voltage restrikes.

BRIEF DESCRIPTION OF THE DRAWINGS

For a better understanding of the invention reference may be had to the preferred embodiments shown herein in which.

DESCRIPTION OF THE PREFERRED EMBODIMENTS

Figure 2:
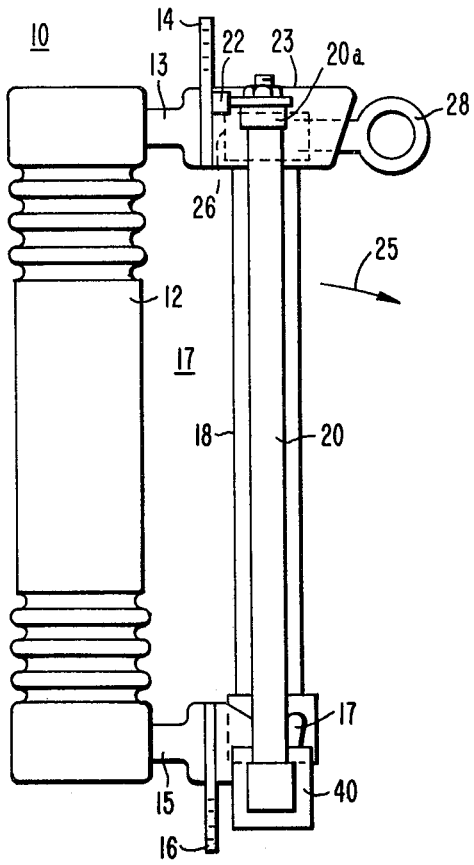
FIG. 2 shows a side elevation of the fuse structure of FIG. 1.
Figure 1:
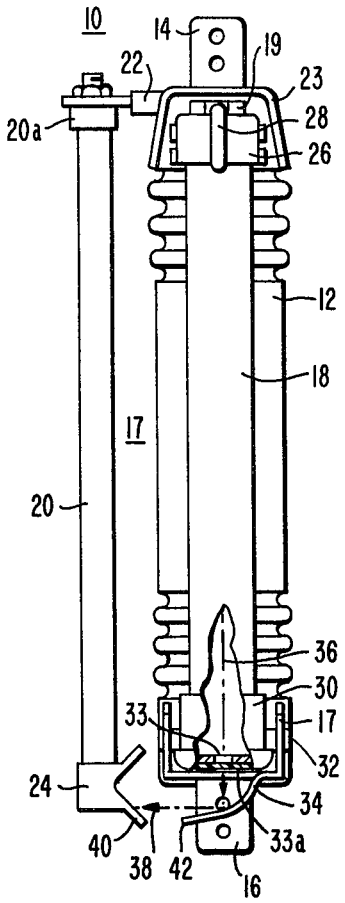
FIG. 1 shows a front elevation partially broken away of a fuse structure.

Referring now to the drawings and FIG. 1 and FIG. 2 in particular, a fuse device 10 for providing relatively high rated current flow and relatively high fault current limitation is shown. In this embodiment of the invention there is provided a support base 12 which may be a porcelain insulator or the like. The support base 12 may be vertically disposed as shown in FIG. 1 and FIG. 2 or may be disposed at some small displaced angle from the vertical. At the upper and lower ends of the support base 12 as shown in FIG. 1 and FIG. 2 are provided support brackets 13 and 15 respectively upon which a fuse structure 17 may be disposed. Fuse structure 17 may comprise an expulsion type fuse 18 and a current limiting fuse 20. The expulsion type fuse 18 is electrically connected to and may support a ferrule **20*a* of the current limiting fuse 20. In this embodiment of the invention an upper terminal pad 14 is provided for electrical connection with an external source of voltage and/or load, neither of which are shown in the drawings. An electrically conducting member 22 may be electrically interconnected with the terminal pad 14 and the bracket 13. The electrically conducting member 22 may be electrically connected to the ferrule 20*a* of the current limiting fuse 20 and to the ferrule 26 of the expulsion type fuse 18. There may also be provided a hood or shielding member 23 which at least partially encloses the ferrule 26. The hood 23 may be electrically conducting in certain embodiments of the invention and may add to the total overall electrical continuity between the ferrule 20*a* of the current limiting fuse 20 and the ferrule 26 of the expulsion fuse 18. The terminal pad 14 is in a disposition of electrical conductivity with both the ferrule 20***a* of the current limiting fuse 20 and the ferrule 26 of the expulsion type fuse 18. Generally speaking, therefore, it may be said that the ferrule 20*a*, the ferrule 26 and the terminal pad 14 are at the same electrical potential. There may be provided as part of the ferrule 26 an eyelet 28 suitable for being captured or engaged by a hook or similar disengaging means. The hook or similar means (now shown) which may be mounted at the end of a long electrically insulating pole may be utilized for rotating the fuse 18 away from the region of the hood 23 in a radial arc generally defined by the arrow 25 about a point on a hinge 17 which will be described in more detail hereinafter. In a preferred embodiment of the invention the fuse body 18 may be rotated to a final disposition which is in a range between 130° and 180° from the position shown in FIG. 1 and FIG. 2 to thus provide an insulating gap between the hinge 17 and the hood 23 which is essentially equal in distance to the length of the barrel of the fuse 18. There may be provided a mechanical interlinkage (not shown) within the barrel of the fuse 18 which causes automatic disengagement of the ferrule 26 from the region of the hood 23 after a fusing operation has taken place to consequently allow the force of gravity to aid in disposing the barrel of fuse 18 in the previously described displaced angular position relative to the position shown in FIG. 1 and FIG. 2. Electrically interconnected with the bracket 15 may be a terminal pad 16 for completing the electrical connection with the external load and/or source. Also interconnected with the bracket 15 and the terminal pad 16 may be the previously described hinge member 17. The hinge member 17 may have a pair of recesses (not shown) in which horizontally oriented pivot pins 32 of a ferrule 30 may be disposed for assisting in the previously described rotating operation. There may be disposed on the bottom of the fuse ferrule 30 a gas deflector plate 34. Alternately, the gas deflector plate 34 may be disposed as part of the fixed hinge member 17. There may be provided in the ferrule 30 an opening 33. The opening 33 communicates with the inner portion of the fuse 18. There may be disposed over the opening 33 a covering 33*a* which may comprise vinyl or similar material.

Disposed at the other end of the current limiting fuse 20 is a second ferrule 24 which may have a deflector cooperation plate 40 disposed thereon. It will be noted that the ferrule 24 is not in electrical contact with the terminal pad 16, the deflector plate 34, the support hinge member 17, or the ferrule 30.

A contiguous electrically conducting path exists from the terminal pad 14 through the member 22 and/or 23 to the ferrule 26, through the body of the fuse 18 to the ferrule 30 and through the pivot pins 32 and the support member 17 to the other terminal pad 16. On the other hand, the current limiting fuse 20 is generally not structurally connected in electrical circuit relationship with the fuse 18 except at the support member 22. Consequently, when electrical current flows from the external source (not shown) through the expulsion type fuse 18 by way of the terminal pads 14 and 16, the current limiting fuse 20 is not connected in either series or parallel circuit relationship therewith. An expulsion type fuse generally has the characteristic of providing relatively low impedance to the flow of AC or DC electrical current during non-fusing and non-blown operation. On the other hand, the current limiting fuse 20 generally provides relatively high impedance to the flow of electrical current therethrough. However, since the latter fuse is not connected in either series or parallel circuit relationship with the source, it cannot act to seriously affect the flow of current from the source into and out of the terminal pads 14 and 16 during a non-fusing and non-blown operation.

In the event of a relatively low magnitude fault current flow at terminals 14 and 16, the electrical current flowing in the expulsion fuse 18 will generally evolve a relatively low amount of arc quenching gas. The amount of gas evolved is related to the amount of fault current. Such being the case the pressure of the gas relative to the internal portion of the barrel of the fuse 18 will be generally of insufficient magnitude to dislodge the covering 33*a*. This is preferred in a low magnitude fault current situation because generally a low magnitude fault current does not require a current limiting action for circuit protection. As a result, the expulsion fuse would simply act as it always does under such conditions and the current limiting fuse 20 would not be brought into the fusing operation because the gas which is necessary between the bottom portion of fuse 18 and the bottom portion of fuse 20 to cause voltage breakdown and flash-over in that region would not be provided. However, if the magnitude of fault current through the fuse element of fuse 18 is significant, it is likely that current limitation will be required for adequate external circuit protection or for the decrease in Rate of Rise of Recovery Voltage which accompanies the insertion of a significant arc resistance into the circuit as the current limiting fuse operates. In such a case, it is also likely that the amount of gas evolved during the operation of the expulsion type fuse 18 will be sufficient in pressure to blow out the covering 33*a* and thus be directed by deflector 34 into the region between ferrule 30 and ferrule 24. The presence of hot gas in the gap between the ferrule 24 and the ferrule 30 tends to introduce an electric arc generally between the ferrule 24 and the ferrule 30. This arc comprises a current path which essentially places the current limiting fuse 20 in parallel with the expulsion fuse 18. In general, the arc which is struck between the ferrule 24 and the ferrule 30 replaces or is a substitute for the arc which normally exists between the separating portions of the mechanically driven isolating portion of the expulsion type fuse 18 such as is described in the previously mentioned U.S. Pat. No. 3,401,245. Of course, when this happens, the fault current in essence is commutated to the current limiting fuse 20 and the expulsion type fuse essentially no longer conducts significant current. Meanwhile, the mechanical separator which is located in the expulsion type fuse continues to provide an ever widening insulating gap between series connected portions of the expulsion type fuse 18. The fuse element (not shown) of current limiting fuse 20, due to the presence of the relatively high fault current flowing therethrough, melts and introduces and causes the formation of a current limiting arc within the barrel of the fuse 20, thus tending to limit the current flowing in the external circuit to be protected and/or to decrease the Rate of Rise of the system restored voltage, making circuit interruption less difficult.

Figure 3A:
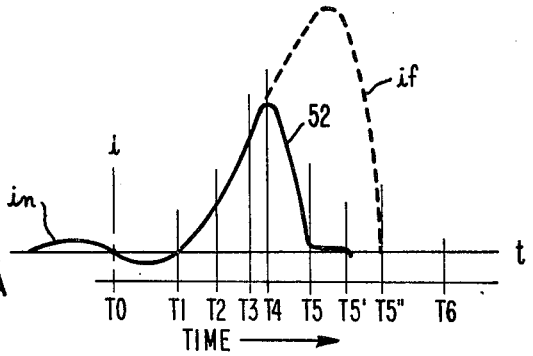
FIG. 3A shows a plot of fuse device terminal voltage versus time during a fusing operation.
Figure 3B:
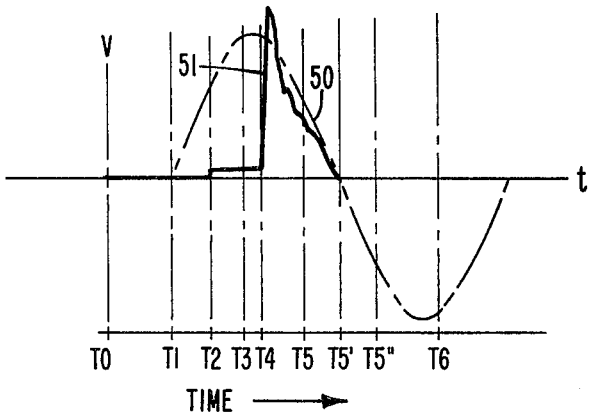
FIG. 3B shows a plot of fuse device terminal current versus time during the time span of FIG. 3A.

Referring now to FIG. 3A and FIG. 3B, plots of fault current versus time and fuse terminal voltage versus time respectively are shown. In general the time scales of the two plots of FIG. 3A and FIG. 3B correspond. It can be seen that between the times TO and Tl the current in is normal, is of a low magnitude relative to a potential fault current if and is generally represented in the preferred embodiment of the invention by a symmetrical AC sine wave. By referring to FIG. 3B, it can also be noted that during the latter time the voltage 50 between the terminals 14 and 16 is generally zero, ignoring of course some minor fuse losses. However, at time Tl, which is arbitrarily chosen to correspond to a zero crossing of the voltage wave 50 for purposes of illustration only, an electrical fault is introduced into the system to be protected by the fuse device 10. This causes a rise in fuse current as is depicted in the region between the time T1 and time T2. At this time, the voltage between the terminals 14 and 16 is generally of a relatively low value. However, at time T2 the fuse element of the expulsion type fuse 18 melts. This causes an arc voltage 51 to be inserted in the fuse 18 in series with the terminals 14 and 16. This is represented in the voltage curve of FIG. 3B by a very small step in voltage at T2. Between the time intervals T2 and T3 the fuse current in continues to follow the fault current curve if by rising dramatically towards an extremely high value of peak fault current. At this time the arc voltage 51 within the fuse 18 continues to rise gradually. As can be seen by additional reference to FIG. 1, at time T3, for purposes of illustration, it is presumed that the arc voltage 51 in fuse 18 has caused sufficient gas to be evolved in the barrel of fuse 18 to dislodge the vinyl covering 33*a* to allow gas 36 to escape through the hole 33 and deflect against the deflector plate 34. Its new direction is generally 38. This causes an accumulation of hot gases between the end 42 of the deflector 34 and the acceptor 40, for example. Consequently, an electrical flash-over occurs, as was described previously, and current is then commutated to and conducted through the current limiting fuse 20. The time span between the time point T3 and time point T4 represents the flow of fault current if through the fuse 20 which leads to melting of that fuse at time T4. While this is occurring, the mechanically separating portions of the expulsion type fuse 18 continue to move further away from each other even though the arc which was originally struck therebetween has now been transferred to the region between the ferrule 24 and the ferrule 30. At time T4 the fuse element of the current limiting fuse 20 melts. This latter action operating in cooperation with external circuit inductance introduces voltage step function of an extremely high magnitude between the terminals 14 and 16. The voltage 51 therefore tends to be larger than the source voltage which is represented by curve 50 in FIG. 3B. This of course has the effect of providing a current limiting action for fault current if. Consequently, it can be seen that after time T4 the fault current follows the path 52 which represents significant current limitation rather than the path if which represents the maximum available fault current path. As this happens, the arc voltage 51 of the fuse 20 diminishes as is shown in FIG. 3B. At some time T5 the current 52 reaches a near zero value after which it may be sustained due to mechanical and electrical properties until a time T5′ at which it becomes zero by natural commutation. It will be noted that the projected zero crossing of the maximum unlimited fault current as depicted by the curve if would not occur until a time T5″. At some time after the time T5′, which time is generally designated T6, a mechanical operation of the expulsion type fuse will cause the barrel of fuse 18 to rotate in the direction 25 to provide significant electrical isolation between the terminals 14 and 16. It will be noted that after the voltage 51 of FIG. 3B reaches zero, which generally is at the time T5′, the voltage across the terminals 14 and 16 will generally continue to oscillate as normal AC voltage even though circuit current no longer flows. It is also to be noted that by time T5 the mechanical separator portions of the fuse 18 have separated to a significant extent so that a restrike of the arc in the fuse 18 is highly unlikely.

It is to be understood that the choice of a particular type of expulsion type fuse 18 or a particular type of current limiting fuse 20 is not limiting and that other kinds of expulsion type fuses and/or other types of current limiting fuses may be used. It is also to be understood that in some embodiments of the invention that the mechanical electrical interconnection between the fuse 20 and the fuse 18 may occur at the bottom of those fuses rather than at the top as is shown in FIG. 1 and FIG. 2. It is also to be understood with respect to FIG. 3A and FIG. 3B that the time intervals shown therein are merely illustrative of relative occurrences and are not to be considered as precise. It is also to be understood that the relative difference between maximum fault current and maximum rated current may be as high as 1,000 to 1. It is also to be understood that the peak of the current limiting voltage of FIG. 3A, shown at time T4 may be as high as 45,000 volts if the peak of the normal AC voltage is approximately 15,000 volts. It is to be understood that a fault may be initiated at any point on the curve 50 of FIG. 3B not only at the zero crossing. It is also to be understood that the evolved gas from fuse 18 may be the result of interacting the electric arc struck therein with a boric acid compound. It is also to be understood that in some embodiments of the invention the current limiting fuse may be so mechanically affixed to the expulsion fuse at the top of the expulsion fuse that both unit barrels 18 and 20 will rotate together in the direction 25 due to the mechanical operation of the expulsion fuse.

The apparatus embodying the teachings of this invention has several advantages. For example, the expulsion type fuse 18 is adapted for conducting high normal rated current without introducing relatively large impedance into the circuit to be protected. In the event of a relatively low level fault current, a relatively low amount of gas will be evolved in the fuse 18. Consequently insufficient gas will be evolved to attain a gas pressure within the barrel of fuse 18 to dislodge the covering 33*a* to thus cause an arc to be struck between the conducting regions around ferrules 24 and 30. Such being the case the current limiting fuse will not and generally need not be introduced in circuit relationship into the path of the external circuit to be protected. Another advantage lies in the fact that since the current limiting action is generally separated from the initial interrupting action either the current limiting fuse or the expulsion fuse may be replaced if necessary independently of the other. Another advantage lies in the fact that the mechanical separation of internal portions of the expulsion type fuse 18 generally significantly limits the opportunity for restrike after the current limiting operation of fuse 20 has begun. Another advantage lies in the fact that the arc quenching evolved gas may be put to a further use than was normally considered in the prior art by allowing it to vent from the barrel of the tube and be thereafter purposely directed to cause a voltage flash-over which ultimately leads to a beneficial current limiting action. This provides greater utility for the evolved gas. Another advantage lies in the fact that the operation of the current limiting fuse serves to insert a high arc impedance into the circuit which decreases the Rate of Rise of the Recovery voltage and causes the interruption to be more easily accomplished even though the available fault current may be of such a lower level that current limitation does not occur.

What I claim as my invention is:

1. Fuse apparatus which is capable of conducting a relatively high value of rated current and of providing significant current limitation during a fusing operation, comprising:

a. support means;

b. first fuse means disposed upon said support means, comprising:

1. a first pair of spaced ferrule means which are interconnectable in circuit relationship with a source of electrical current;
2. non-current limiting fuse element means one end of which is connected in circuit relationship with one ferrule of said pair of spaced ferrule means;
3. separator means one end of which is connected in circuit relationship with the other ferrule of said pair of spaced ferrule means and the other end of which is connected in circuit relationship with the other end of said first non-current limiting fuse element means for providing a first insulating gap between said spaced ferrules when said non-current limiting fuse element fuses said first gap enlarging in size during a predetermined time;
4. gas evolving means disposed relative to said first fuse element means to evolve electrically conducting gas when said non-current limiting fuse element means fuses;
5. director means for directing said evolved gas;

c. second fuse means disposed on said support means, comprising:

1. a second pair of spaced ferrule means; and
2. current limiting fuse element means one end of which is connected in circuit relationship with one ferrule of said second pair of spaced ferrules and the other end of which is connected in circuit relationship with the other ferrule of said second pair of spaced ferrules, one ferrule of said first pair of spaced ferrule means and one ferrule of said second pair of spaced ferrule means being connected in circuit relationship, the other ferrule of said first pair of spaced ferrule means and the other ferrule of said second pair of spaced ferrule means being spaced from one another to provide a second insulating gap of predetermined size, said director means being oriented to direct said evolved gas into said second gap to provide a current conducting path across said second gap, fusing current in said non-current limiting fuse element means thusly being commutated to said second fuse element means to be limited thereby, said current being prevented from returning to said non-current limiting fuse element means thereafter by an increased enlargement of said first insulating gap.

2. The combination as claimed in claim 1 wherein said first fuse means comprises a first barrel means and said second fuse means comprises a second barrel means, said first pair of ferrule means being spaced at either end of said first barrel means, said second pair of ferrule means being disposed at either end of said second barrel means.

3. The combination as claimed in claim 2 comprises an opening between the interior portion of said first barrel means and the external portions thereof, said opening having a removable cover thereover which is dislodged by said gas when said gas attains a predetermined pressure in said first barrel means, said gas then being provided to said second gap through said opening.

4. The combination as claimed in claim 3 wherein said director means is disposed external to said first barrel means near said opening to direct said gas which exits said opening to said second gap.

5. The combination as claimed in claim 4 wherein said director means is disposed proximate said other of said first pair of spaced ferrule means.

6. The combination as claimed in claim 5 wherein said other of said first pair of spaced ferrule means and said other of said second pair of spaced ferrule means are disposed in side by side spaced relationship.

7. The combination as claimed in claim 6 wherein said first barrel means and said second barrel means are disposed in parallel side by side relationship.

8. The combination as claimed in claim 7 wherein said deflector means comprises a member disposed at an angle relative to the exit path of said gas from said opening means to thus change the direction of said exiting gas flow toward said other ferrule of said second fuse means.

9. The combination as claimed in claim 8 wherein said other ferrule of said first fuse means and said deflector means are integral.

10. Fuse apparatus which is capable of conducting a relatively high value of rated current and of providing circuit recovery voltage rate of rise reduction during a fusing operation, comprising:

a. support means;

b. first fuse means disposed upon said support means, comprising:

1. a first pair of spaced ferrule means which are interconnectable in circuit relationship with a source of electrical current;
2. non-current limiting fuse element means one end of which is connected in circuit relationship with one ferrule of said pair of spaced ferrule means;
3. separator means one end of which is connected in circuit relationship with the other ferrule of said pair of spaced ferrule means and the other end of which is connected in circuit relationship with the other end of said first non-current limiting fuse element means for providing a first insulating gap between said spaced ferrules when said non-current limiting fuse element fuses, said first gap enlarging in size during a predetermined time;
4. gas evolving means disposed relative to said first fuse element means to evolve electrically conducting gas when said non-current limiting fuse element means fuses;
5. director means for directing said evolved gas;

c. second fuse means disposed on said support means, comprising:

1. a second pair of spaced ferrule means; and
2. current limiting fuse element means one end of which is connected in circuit relationship with one ferrule of said second pair of spaced ferrules and the other end of which is connected in circuit relationship with the other ferrule of said second pair of spaced ferrules, one ferrule of said first pair of spaced ferrule means and one ferrule of said second pair of spaced ferrule means being connected in circuit relationship, the other ferrule of said first pair of spaced ferrule means and the other ferrule of said second pair of spaced ferrule means being spaced from one another to provide a second insulating gap of predetermined size, said director means being oriented to direct said evolved gas into said gap to provide a current conducting path across said second gap, fusing current in said non-current limiting fuse element means thusly being commutated to said second fuse element means to thus effect the introduction of a high arc resistance to significantly reduce the natural rate of rise of the recovery voltage of the circuit, said current being prevented from returning to said non-current limiting fuse element means thereafter by an increased enlargement of said first insulating gap.

* * * * *